United States Patent [19]

Joffe

[11] 4,379,514

[45] Apr. 12, 1983

[54] BLADE HOLDER AND DISPENSER

[75] Inventor: Edward J. Joffe, Linden, N.J.

[73] Assignee: Howard Strauss, Union, N.J. ; a part interest

[21] Appl. No.: 247,994

[22] Filed: Mar. 26, 1981

[51] Int. Cl.[3] ..... B65G 59/00

[52] U.S. Cl. ..... 221/279; 221/287

[58] Field of Search ..... 221/191, 252, 279, 101, 221/102, 232, 255–257, 268, 269, 197, 198, 281, 287; 220/93; 312/61

[56] References Cited

U.S. PATENT DOCUMENTS

| | | | |
|---|---|---|---|
| 705,578 | 7/1902 | Frederick | 221/279 |
| 1,908,115 | 5/1933 | Chadwick | 221/102 |
| 2,641,358 | 6/1953 | Santo | 221/102 |
| 3,542,245 | 11/1970 | Braginetz | 221/256 |
| 3,650,433 | 3/1972 | Robertson | 221/232 |
| 3,767,083 | 10/1973 | Webb | 221/279 |
| 3,827,597 | 8/1974 | Braginetz | 221/65 |

FOREIGN PATENT DOCUMENTS

| | | | |
|---|---|---|---|
| 293277 | 3/1914 | Fed. Rep. of Germany | 221/279 |

*Primary Examiner*—Kenneth W. Noland

*Attorney, Agent, or Firm*—Colton & Stone, Inc.

[57] ABSTRACT

A holder and dispenser for utility knife blades includes a molded plastic back plate and a cover connected thereto by an integral hinge. Blade dispensing apertures are formed at the ends of the cover and a manually actuable follower moves in an opening extending the length of the cover.

8 Claims, 9 Drawing Figures

BLADE HOLDER AND DISPENSER

BACKGROUND OF THE INVENTION

The present invention pertains to a package or container for holding a quantity of replaceable knife blades which incorporates means for dispensing the blades individually.

The replaceable blade utility knife is a widely used tool employed for cutting carpet, cardboard, drywall sheets, wood and other materials. With such uses the blades are quickly dulled and must be frequently replaced. The typical utility knife blade is a flat metal blade of trapezoidal shape with the longest side having a highly sharpened edge. If stored or packaged loose, these blades are both difficult and dangerous to handle.

A number of packaging and dispensing containers for utility knife blades have been proposed, see, e.g. U.S. Pat. Nos. 3,542,245, Braginety; 3,650,433, Robertson; and 3,827,597, Braginety. The two Braginety devices are relatively complex, each having a blade storage magazine with a spring-loaded follower and a pivotally mounted dispensing tray. The Robertson device includes a base plate with a blade supporting shelf and a cover slideably mounted in the base plate. As individual blades are removed, the cover slides downwardly relative to the base plate, elongating the device. If the cover is slid upwardly to its initial position, for example, to permit the dispenser to be stored, the blades are not maintained in a uniform stack which may result in jamming during subsequent use.

It is an object of the present invention to provide a compact, easily used holder and dispenser for replaceable knife blades.

Another object of the invention is the provision of a blade holder and dispenser which may be used with blades of two or more different sizes without modification of the unit.

A further object is the provision of a blade dispenser package which is economically manufactured.

SUMMARY OF THE INVENTION

The above and other objects of the invention which will become apparent hereinafter are achieved by the provision of a blade holder and dispenser having a rectangular back plate and a cover connected to one lateral edge of the back plate by an integral hinge, the cover having parallel end walls and inclined side walls to define, with the base, a storage magazine for a quantity of blades, the side walls terminating in rails on which a manually actuable follower moves for maintaining the blades in stacked relation, each side wall has a blade dispensing slot immediately adjacent each end wall and a finger aperture is formed directly opposite the dispensing slot and along a portion of the end wall. The dispensing slots at opposite ends of the holder are of different widths to allow for the dispensing of blades of different thicknesses.

For a more complete understanding of the invention and the objects and advantages thereof reference should be had to the following detailed description and the accompanying drawings wherein a preferred embodiment of the invention is described and shown.

DETAILED DESCRIPTION OF THE PREFERRED EMBODIMENT

Figure 2:
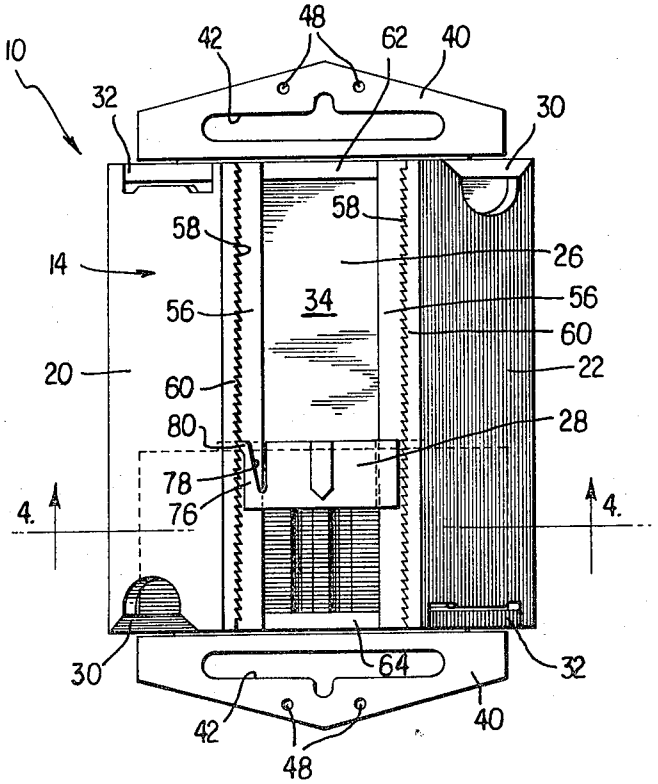
FIG. 2 is a front elevational view of the assembly of FIG. 1.
Figure 1:
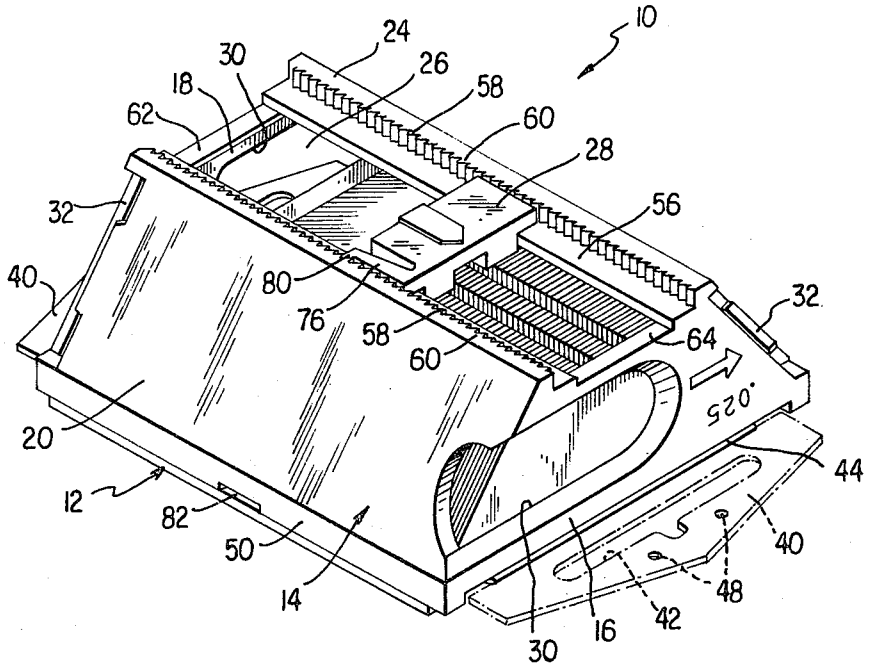
FIG. 1 is a perspective view of the blade holder and dispenser assembly of the present invention.
Figure 5:
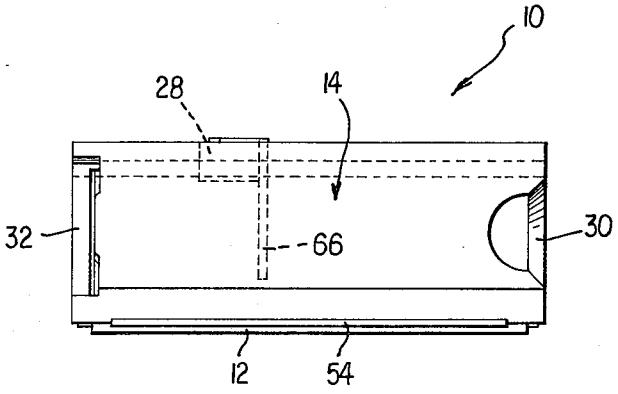
FIG. 5 is a partial side elevational view taken from the plane 5—5 of FIG. 3.

The blade holder and dispenser, designated generally by the reference numeral 10, is of molded plastic construction and includes a back plate 12 and a cover 14 which together define a magazine for holding a quantity, such as 100, of replaceable knife blades. The cover has opposed end walls 16, 18, inclined side walls 20, 22 and a front face 24 having an opening 26 extending between the end walls 16 and 18 in which is received a follower plate 28. At least one and preferably each of the end walls 16, 18 and the adjacent portion of the corresponding side wall 20, 22 is provided with a finger aperture 30 and a blade discharge slot 32 is formed in the opposing side wall.

Figure 4:
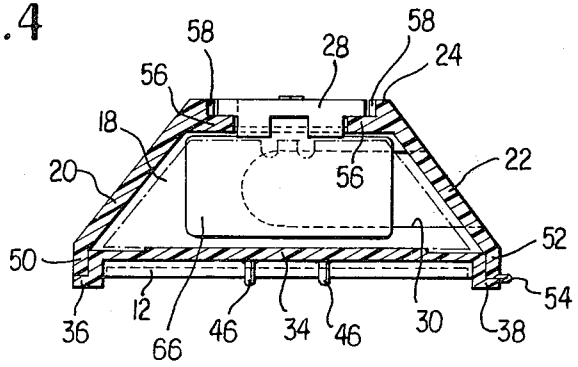
FIG. 4 is a transverse sectional view taken on the line 4—4 of FIG. 2.
Figure 6:
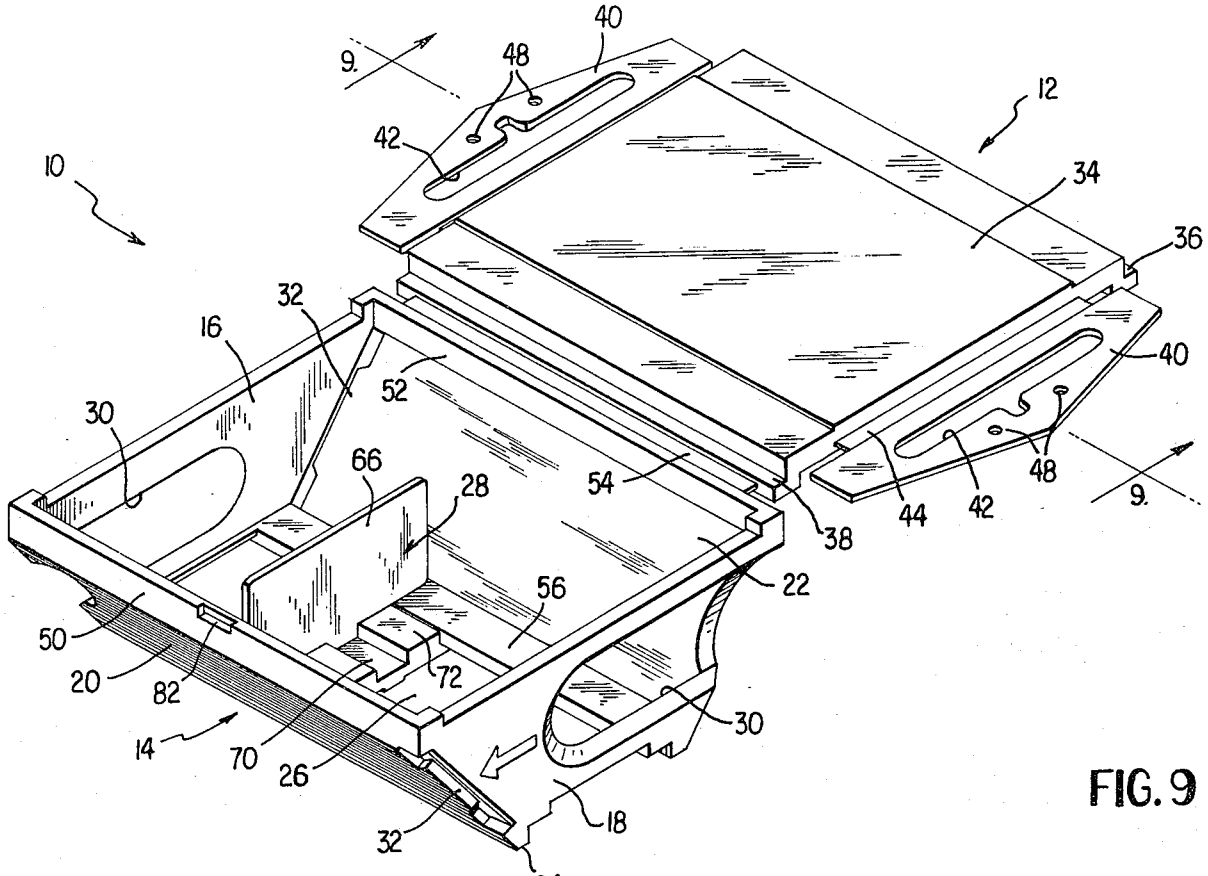
FIG. 6 is a perspective view of the holder and dispenser assembly opened for loading with a quantity of blades.
Figure 9:
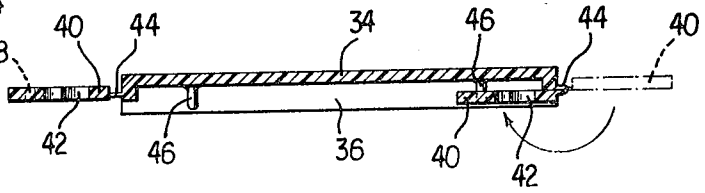
FIG. 9 is a transverse sectional view taken on the line 9—9 of FIG. 6.

The back plate 12, shown most clearly in FIGS. 4, 6 and 9, includes a rectangular main portion 34 with flanges 36, 38 on opposite lateral sides thereof, offset from the front face of the portion 34. At each end of the back plate, there is provided a tab or wing 40, having an aperture 42 by which the holder and dispenser may be suspended. The web portions 44 connecting the wings to the back plate may include zones of reduced thickness functioning as hinges. This permits the wings to be folded inwardly for more compact packaging of the dispenser, as shown in FIG. 9. Lugs 46 may be provided on the rear face of the back plate for engagement with holes 48 in the wings for retaining the wings in their folded positions.

The cover 14 is configured so as to mate with the back plate 12, the rear ends of the inclined side walls 20, 22 terminating in vertical walls 50, 52 which closely fit the lateral edges of the back plate and abut the flanges 36, 38. The lateral edge of the back plate flange 38 and the cover wall 52 are joined along the lengths thereof by a thin web 54 functioning as a hinge. The front wall 24 of the cover has a central opening 26 extending the length thereof and bordered on each side by a rail 56 inset from the front face of the cover. Saw tooth like serrations 58 are provided on the lateral edges 60 of the front wall 24 and, as can be seen in FIG. 2, the serrations on opposite sides of the opening 26 are directed oppositely to one another to permit reversal of the follower, as will be described more fully below. The top and bottom walls 16, 18 of the cover are notched with the end portions 62 thereof in alignment with the front wall lateral edges 60 and the front surfaces of the rails 56 and with central portions 64 substantially aligned with the rear edges of the rails 56.

Figure 7:
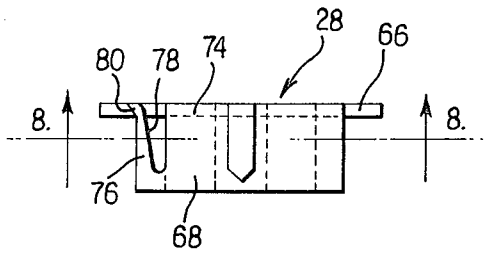
FIG. 7 is a plan view of the follower included in the assembly of FIG. 1.
Figure 8:
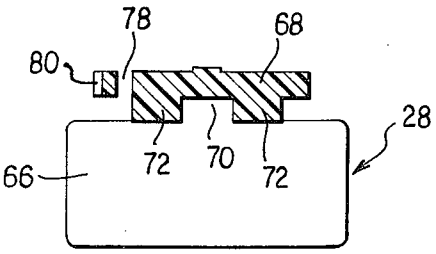
FIG. 8 is a transverse sectional view taken on the line 8—8 of FIG. 7.
Figure 3:
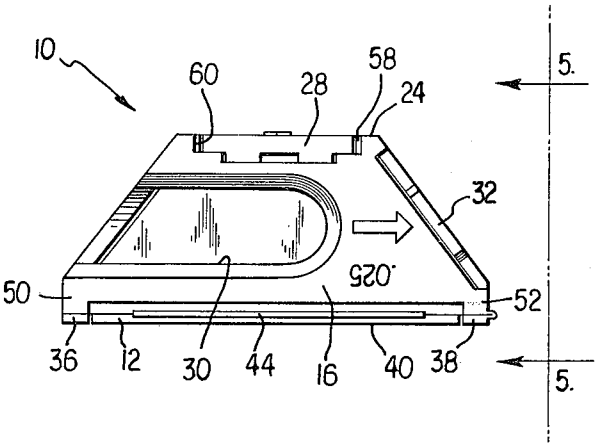
FIG. 3 is a bottom plan view thereof.

Received in the central opening 26 and supported on the rails 56 is a follower, designated generally by the numeral 28 and illustrated in FIGS. 7 and 8. The follower is comprised of a rectangular plate 66, a front portion 68 perpendicular to the plate 66 and a neck portion 70 connected to the plate and the front portion. The width of the front portion is substantially equal to the distance between the serrated edges 60 of the front wall 24. The rear face of the front portion carries a pair of ribs 72 dimensional so as to be slideably received between the lateral edges of the rails 56. The front portion is divided into a main section 74 and an arm 76 by a notch 78 extending from the end of the front portion adjacent the plate 66. At the forward end of the arm and projecting laterally therefrom is a pawl 80.

Loading the dispenser involves positioning the follower so that the plate 66 is immediately adjacent the upper end wall 18 of the cover and placing a suitable quantity of blades in the cover, the blades being parallel to the end walls and with their sharpened edges toward the open back of the cover. At this time the back plate 12 is pivoted about the hinge 54 to mate with the cover 14 completing the assembly of the dispenser. Preferably, the wings 40 are folded against the rear wall of the back plate 12 and retained by the lugs 46 so that the dispensers may be packaged and stored in a minimum of space. While the holder and dispenser is intended to be a single use item and not refilled, a notch 82 may be provided in the lower wall 50 of the cover opposite the hinge connection 54 to allow a screwdriver blade to be inserted to open the dispenser.

In use one of the wings 40 is hinged to project from the top end of the dispenser 10 and the blade holder and dispenser is suspended by any suitable means such as a nail, screw or hook engaging the aperture 42 of the wing 40. To dispense a single blade, the user pushes laterally on the lowermost blade through the finger aperture 30, moving this blade through the corresponding discharge slot 32 from which the blade may easily be grasped along the edge opposite the knife edge. The width of the discharge slot is greater than the thickness of a single blade but less than the thickness of two blades so that only one blade is dispensed at a time. As successive blades are removed, the follower 28 is moved manually downwardly maintaining the blades in a uniform stack. As will be noted in FIG. 2, the configurations of the serrations 58 and of the pawl 80 are designed to permit movement of the follower toward the lower blade discharge end of the dispenser while preventing reverse movement thereof.

The illustrated embodiment of the blade holder and dispenser is designed for use with a variety of sizes of blades, having finger apertures 30 and dispensing slots 32 at each end of the cover 20. With this arrangement, the widths of the two apertures differ, the slot at one end of the device being capable of dispensing a single 0.025 inch thick blade while the slot at the opposite end dispenses a single 0.018 inch thick blade, for example. When the opposite dispensing slot from that described in the preceeding paragraph is used, the follower 28 is reversed so that the pawl 80 cooperates with the serrations 60 and the wing 48 is used to suspend the dispenser. As the serrations 60 are directed oppositely to the serrations 58, that is with the perpendicular faces of the serrations toward the end wall 18, the follower 28 is movable toward the wall 18 while being restrained from movement in the opposite direction. It is, of course, also possible to provide the dispenser with two followers, initially placed in back-to-back relationship at approximately the center of the unit, and to load the dispenser with different sizes of blades in the resulting sections of the magazine.

While a specific embodiment of the blade holder and dispenser of the present invention has been illustrated and described, it will be understood that changes and additions may be made therein and thereto. Reference should, accordingly, be had to the appended claims in determining the true scope of the invention.

What is claimed is:

1. A holder and dispenser for replaceable knife blades comprising:

a back plate having a rectangular main portion;

a cover having a front face, opposed side faces and opposed end faces, said cover mating with said back plate to define therewith a magazine for receiving a plurality of blades in stacked relation, at least one end face having an aperture extending partially thereacross from one side face, the opposite side face having a blade discharge slot immediately adjacent said one end face, the front face having an opening extending the length thereof and, on each side of said opening and extending the length thereof, a rail recessed from the front surface of said front face; and a manually movable follower slideably received in said opening of said front face, said follower including a plate portion projecting into said magazine and shoulder portions slidingly engaging each of the rails of the sides of the opening.

2. The holder and dispenser of claim 1 wherein ratchet means are provided along one side of said opening and said follower includes a cooperating pawl whereby said follower is movable toward but not away from said one end face.

3. The holder and dispenser of claim 2 wherein said ratchet means extends along lateral walls defined between the front surface of said front face and said rails, said follower having a substantially planar front portion extending perpendicular to the plate portion thereof, of a width substantially equal to the distance between said lateral walls, and having a notch dividing said front portion into a main section and an arm, said pawl being formed at the free end of said arm.

4. The holder and dispenser of claim 1, 2 or 3 wherein said back plate and said cover are of molded plastic construction and an integrally molded plastic web functioning as a hinge connects one lateral edge of said back plate to one side face of said cover.

5. A holder and dispenser for replaceable knife blades comprising:

a container having a front wall, a back wall, upper and lower end walls and opposed side walls and adapted to hold a plurality of blades in stacked relation and parallel to said end walls, at least the lower end wall having a finger aperture and one side wall having a blade discharge slot immediately adjacent said lower end wall, said front wall having a central opening extending the length thereof and, on each side of said central opening, a rail extending the length of said central opening and offset rearwardly from the front surface of said front wall; and a manually movable follower slideably received in said central opening of said front wall and including a plate portion extending within said container for contacting the uppermost of the stacked blades and a front plate portion perpendicular to said firstmentioned plate portion, said front plate portion being slideable on the front faces of said rails of the sides of the central opening.

6. The holder and dispenser of claim 5 wherein ratchet means are provided along at least one lateral edge of said central opening and said follower includes a pawl engaging said ratchet means whereby said follower is movable toward but not away from said lower end wall.

7. The holder and dispenser of claim 7 wherein said ratchet means is formed on the lateral portion of said front wall forward of said rail and said front plate portion of said follower includes a main portion joined to said firstmentioned plate portion at one end thereof and an arm connected to the opposite end of said main portion and extending parallel thereto, said pawl being formed on the free end of said arm.

8. The holder and dispenser of claim 5, 6 or 7 wherein finger apertures and blade dispensing slots are formed at each end of said container and said follower is reversible.

* * * * *